US011274569B2

(12) United States Patent
Ennacer et al.

(10) Patent No.: US 11,274,569 B2
(45) Date of Patent: Mar. 15, 2022

(54) TURBINE SHROUD COOLING

(71) Applicant: PRATT & WHITNEY CANADA CORP., Longueuil (CA)

(72) Inventors: Mohammed Ennacer, Saint-Hubert (CA); Ion Dinu, Candiac (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 207 days.

(21) Appl. No.: 16/662,477

(22) Filed: Oct. 24, 2019

(65) Prior Publication Data

US 2020/0149429 A1 May 14, 2020

Related U.S. Application Data

(63) Continuation-in-part of application No. 15/840,492, filed on Dec. 13, 2017, now Pat. No. 10,502,093.

(60) Provisional application No. 62/879,737, filed on Jul. 29, 2019.

(51) Int. Cl.
*F01D 25/12* (2006.01)
*F01D 11/08* (2006.01)

(52) U.S. Cl.
CPC ..... *F01D 25/12* (2013.01); *F01D 11/08* (2013.01); *F05D 2240/11* (2013.01); *F05D 2260/201* (2013.01); *F05D 2260/202* (2013.01)

(58) Field of Classification Search
CPC . F01D 25/12; F01D 11/08; F01D 9/04; F01D 11/18; F05D 2240/11; F05D 2260/201; F05D 2260/202
See application file for complete search history.

(56) References Cited

U.S. PATENT DOCUMENTS

| | | | |
|---|---|---|---|
| 3,831,258 | A | 8/1974 | Elbert et al. |
| 4,137,619 | A | 2/1979 | Beltran et al. |
| 4,383,854 | A | 5/1983 | Dembowski et al. |
| 4,604,780 | A | 8/1986 | Metcalfe |
| 4,871,621 | A | 10/1989 | Bagley et al. |
| 5,010,050 | A | 4/1991 | Wullenweber et al. |
| 5,130,084 | A | 7/1992 | Matheny et al. |
| 5,486,090 | A | 1/1996 | Thompson et al. |
| 5,538,393 | A | 7/1996 | Thompson et al. |
| 5,553,999 | A | 9/1996 | Proctor et al. |
| 5,574,957 | A | 11/1996 | Barnard et al. |
| 5,772,748 | A | 6/1998 | Hubbard |
| 5,933,699 | A | 8/1999 | Ritter et al. |
| 5,950,063 | A | 9/1999 | Hens et al. |
| 6,102,656 | A | 8/2000 | Nissley et al. |
| 6,217,282 | B1 | 4/2001 | Stanka |
| 6,350,404 | B1 | 2/2002 | Li et al. |
| 6,547,210 | B1 | 4/2003 | Marx et al. |

(Continued)

*Primary Examiner* — Michael Lebentritt
*Assistant Examiner* — Brian Christopher Delrue
(74) *Attorney, Agent, or Firm* — Norton Rose Fulbright Canada LLP

(57) ABSTRACT

A turbine shroud segment has a body extending axially between a leading edge and a trailing edge and circumferentially between a first and a second lateral edge. Upstream and downstream plenums are defined in the body. The upstream plenum has a plurality of cooling inlets. The downstream plenum has a plurality of cooling outlets. A flow constricting slot extends across the body between the first and second lateral edges. The flow constricting slot fluidly connects the downstream plenum to the upstream plenum.

12 Claims, 6 Drawing Sheets

(56) References Cited

U.S. PATENT DOCUMENTS 6,595,750 B2 7/2003 Parneix
6,679,680 B2 1/2004 Um et al.
6,709,771 B2 3/2004 Allister
6,776,955 B1 8/2004 Lim et al.
6,857,848 B2 2/2005 Fokine et al.
6,874,562 B2 4/2005 Knott et al.
6,910,854 B2 6/2005 Joslin
6,939,505 B2 9/2005 Musso et al.
6,974,308 B2 12/2005 Halfmann
7,029,228 B2 4/2006 Chan et al.
7,052,241 B2 5/2006 Decker
7,114,920 B2 10/2006 Synnott
7,128,522 B2 10/2006 Jutras
7,175,387 B2 2/2007 Kreis et al.
7,217,081 B2 5/2007 Scheurlen et al.
7,234,920 B2 6/2007 Imbourg et al.
7,306,424 B2 12/2007 Romanov et al.
7,407,622 B2 8/2008 Voice et al.
7,513,040 B2 4/2009 Cunha et al.
7,517,189 B2 * 4/2009 Camus ..... F01D 9/04 415/173.1
7,621,719 B2 11/2009 Lutjen et al.
7,625,178 B2 12/2009 Morris
7,687,021 B2 3/2010 Imbourg et al.
7,857,581 B2 12/2010 Mons et al.
7,875,340 B2 1/2011 Cho et al.
8,313,301 B2 11/2012 Hudson
8,366,383 B2 2/2013 Thibodeau et al.
8,449,246 B1 5/2013 Liang
8,459,934 B2 6/2013 Hofmann
8,727,704 B2 5/2014 Lee
8,814,507 B1 * 8/2014 Campbell ..... F01D 25/14 415/173.1
8,985,940 B2 3/2015 Zhang
9,028,744 B2 5/2015 Durocher et al.
9,611,754 B2 4/2017 Taylor
9,677,412 B2 6/2017 Jones
9,689,273 B2 6/2017 Jones
9,784,125 B2 10/2017 Duguay
9,920,647 B2 3/2018 Jones
9,926,799 B2 3/2018 Romanov
10,107,128 B2 10/2018 Romanov
10,174,622 B2 1/2019 Zhang
10,196,917 B2 2/2019 Lutjen et al.
2005/0214156 A1 9/2005 Troitski et al.
2009/0129961 A1 5/2009 Lavoie
2010/0025001 A1 2/2010 Lee et al.
2011/0033331 A1 2/2011 Tuppen et al.
2011/0250560 A1 10/2011 Kwon et al.
2012/0186768 A1 7/2012 Sun et al.
2013/0028704 A1 1/2013 Thibodeau
2013/0071227 A1 * 3/2013 Thibodeau ..... F01D 9/04 415/1
2015/0093281 A1 * 4/2015 Campomanes ..... B22F 5/10 419/38
2016/0169016 A1 6/2016 Blaney et al.
2016/0305262 A1 * 10/2016 Durocher ..... B22F 5/10
2017/0211415 A1 7/2017 Swift et al.

* cited by examiner

TURBINE SHROUD COOLING

RELATED APPLICATION

This application claims priority on U.S. provisional application No. 62/879,737 filed Jul. 29, 2019 and is a continuation-in-part of U.S. application Ser. No. 15/840,492 filed Dec. 13, 2017, the entire content of which is incorporated by reference herein.

TECHNICAL FIELD

The application relates generally to turbine shrouds and, more particularly, to turbine shroud cooling.

BACKGROUND OF THE ART

Turbine shroud segments are exposed to hot gases and, thus, require cooling. Cooling air is typically bled off from the compressor section, thereby reducing the amount of energy that can be used for the primary purposed of proving trust. It is thus desirable to minimize the amount of air bleed of from other systems to perform cooling. Various methods of cooling the turbine shroud segments are currently in use and include impingement cooling through a baffle plate, convection cooling through long EDM holes and film cooling.

Although each of these methods have proven adequate in most situations, advancements in gas turbine engines have resulted in increased temperatures and more extreme operating conditions for those parts exposed to the hot gas flow.

SUMMARY

In one aspect, there is a turbine shroud segment for a gas turbine engine having an annular gas path extending about an engine axis, the turbine shroud segment comprising: a body extending axially between a leading edge and a trailing edge and circumferentially between a first and a second lateral edge; an upstream plenum and a downstream plenum defined in the body; a plurality of inlets in flow communication with the upstream plenum; a plurality of outlets in flow communication with the downstream plenum; and a flow constricting slot extending circumferentially between the first and second lateral edges of the body, the flow constricting slot fluidly connecting the downstream plenum to the upstream plenum.

In another aspect, there is provided a turbine shroud segment for a gas turbine engine having an annular gas path extending about an engine axis, the turbine shroud segment comprising: a body extending axially between a leading edge and a trailing edge and circumferentially between a first and a second lateral edge; an internal cavity defined in the body, the internal cavity having a top wall and a bottom wall; a top circumferential band extending from the top wall; a bottom circumferential band projecting from the bottom wall in axial alignment with the top circumferential band, the top circumferential band and the bottom circumferential band defining a circumferential slot therebetween and dividing the internal cavity into an upstream plenum and a downstream plenum, the downstream plenum connected in fluid flow communication with the upstream plenum via the circumferential slot; a plurality of inlets in flow communication with the upstream plenum; and a plurality of outlets in flow communication with the downstream plenum.

In a further aspect, there is provided a method of manufacturing a turbine shroud segment comprising: using a casting core to create an internal cooling circuit of the turbine shroud segment, the casting core having a body including a front portion connected to a rear portion by an intermediate portion, the intermediate portion have a thickness less than that of the front and rear portions to provide for the formation of a transversally extending flow constriction in an intermediate region of the turbine shroud segment, casting a body of the turbine shroud segment about the casting core; and removing the casting core from the cast body of the turbine shroud segment.

DESCRIPTION OF THE DRAWINGS

Reference is now made to the accompanying figures in which.

DETAILED DESCRIPTION

Figure 1:
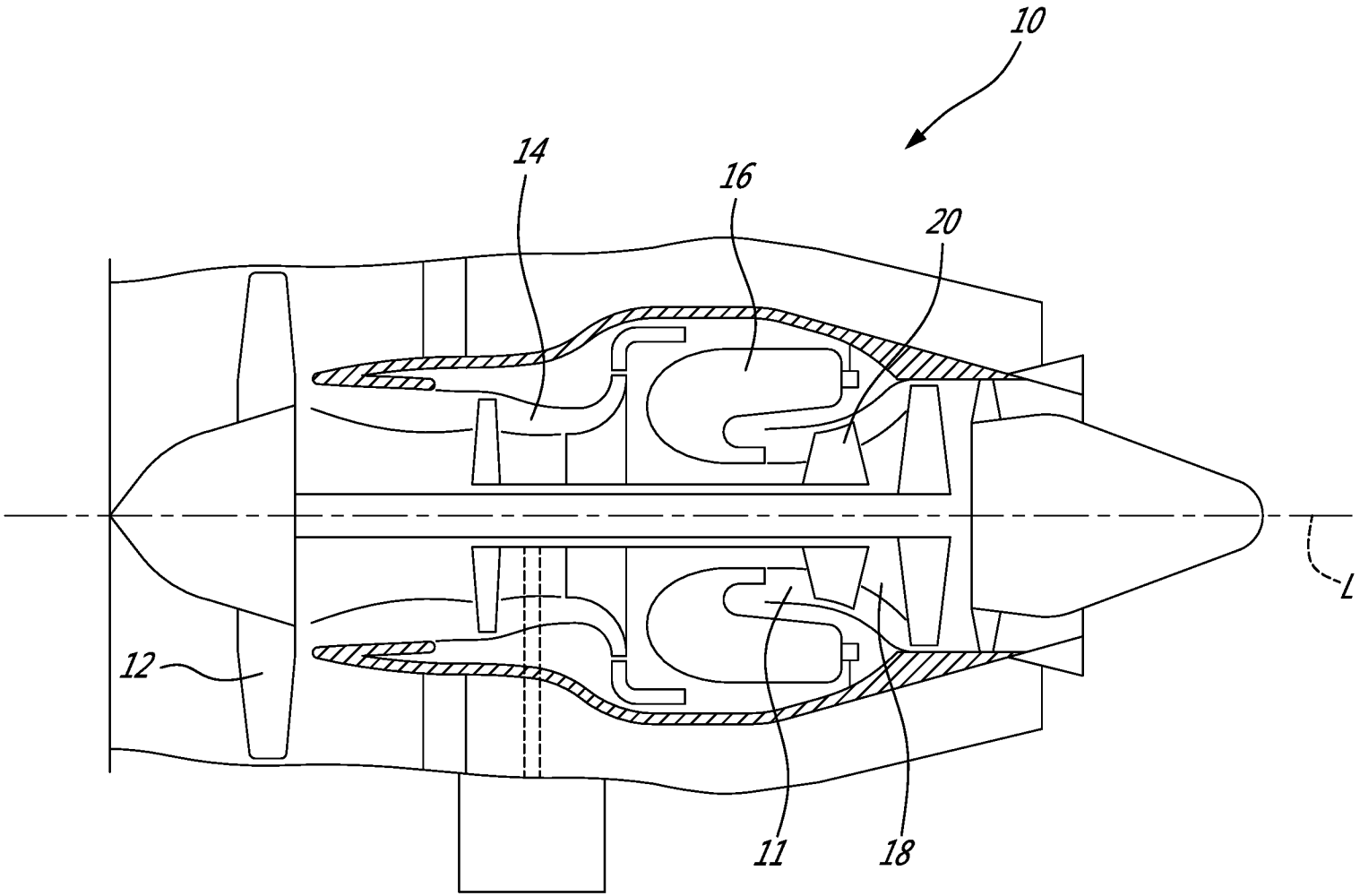
FIG. 1 is a schematic cross-sectional view of a gas turbine engine.

FIG. 1 illustrates a gas turbine engine 10 of a type preferably provided for use in subsonic flight, generally comprising an annular gas path 11 disposed about an engine axis L. A fan 12, a compressor 14, a combustor 16 and a turbine 18 are axially spaced in serial flow communication along the gas path 11. More particularly, the engine 10 comprises a fan 12 through which ambient air is propelled, a compressor section 14 for pressurizing the air, a combustor 16 in which the compressed air is mixed with fuel and ignited for generating an annular stream of hot combustion gases, and a turbine 18 for extracting energy from the combustion gases.

Figure 2:
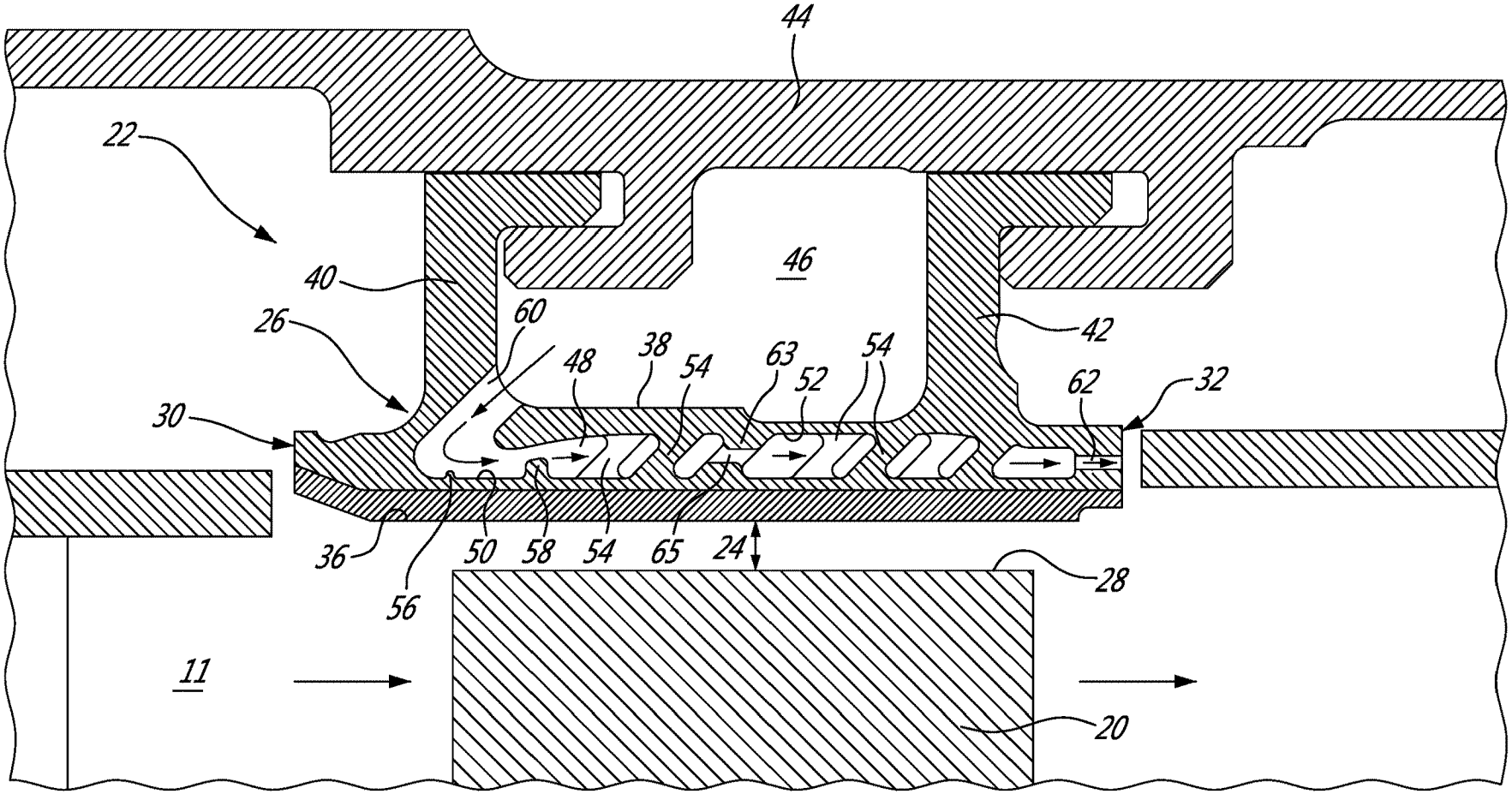
FIG. 2 is a schematic cross-section of a turbine shroud segment mounted radially outwardly in close proximity to the tip of a row of turbine blades of a turbine rotor.

As shown in FIG. 2, the turbine 18 includes turbine blades 20 mounted for rotation about the axis L. A turbine shroud 22 extends circumferentially about the rotating blades 20. The shroud 22 is disposed in close radial proximity to the tips 28 of the blades 20 and defines therewith a blade tip clearance 24. The shroud includes a plurality of arcuate segments 26 spaced circumferentially to provide an outer flow boundary surface of the gas path 11 around the blade tips 28.

Figure 3:
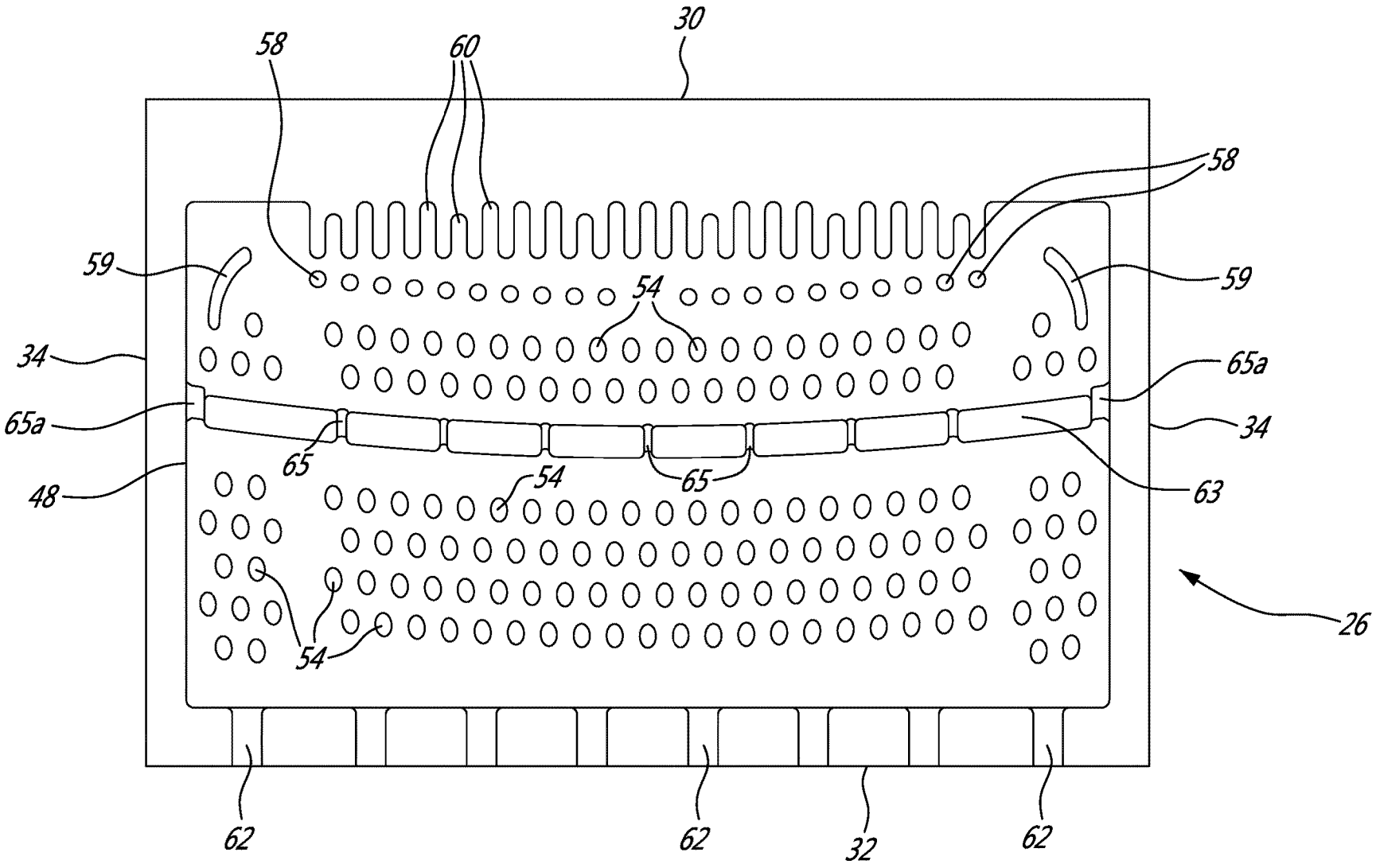
FIG. 3 is a plan view of a cooling scheme of the turbine shroud segment shown in FIG. 2.

Each shroud segment 26 has a monolithic cast body extending axially from a leading edge 30 to a trailing edge 32 and circumferentially between opposed axially extending sides 34 (FIG. 3). The body has a radially inner surface 36 (i.e. the hot side exposed to hot combustion gases) and a radially outer surface 38 (i.e. the cold side) relative to the engine axis L. Front and rear support legs 40, 42 (e.g. hooks) extend from the radially outer surface 38 to hold the shroud segment 26 into a surrounding fixed structure 44 of the engine 10. A cooling plenum 46 is defined between the front and rear support legs 40, 42 and the structure 44 of the engine 10 supporting the shroud segments 44. The cooling plenum 46 is connected in fluid flow communication to a source of coolant. The coolant can be provided from any suitable source but is typically provided in the form of bleed air from one of the compressor stages.

According to the embodiment illustrated in FIGS. 2 and 3, each shroud segment 26 has a single internal cooling scheme integrally formed in its body for directing a flow of coolant from a front or upstream end portion of the body of the shroud segment 26 to a rear or downstream end portion thereof. This allows to take full benefit of the pressure delta between the leading edge 30 (front end) and the trailing edge 32 (the rear end). The cooling scheme comprises a core cavity 48 (i.e. a cooling cavity formed by a sacrificial core) extending axially from the front end portion of the body to the rear end portion thereof. In the illustrated embodiment, the core cavity 48 extends axially from underneath the front support leg 40 to a location downstream of the rear support leg 42 adjacent to the trailing edge 32. It is understood that the core cavity 48 could extend forwardly of the front support leg 40 towards the leading edge 30 of the shroud segment 26. In the circumferential direction, the core cavity 48 extends from a location adjacent a first lateral side 34 of the shroud segment 26 to a location adjacent the second opposed lateral side 34 thereof, thereby spanning almost the entire circumferential extent of the body of the shroud segment 26. The core cavity 48 has a bottom surface 50 which corresponds to the back side of the radially inner surface 36 (the hot surface) of the shroud body and a top surface 52 corresponding to the inwardly facing side of the radially outer surface 38 (the cold surface) of the shroud body. The bottom and top surfaces 50, 52 of the core cavity 48 are integrally cast with the body of the shroud segment 26. The core cavity 48 is, thus, bounded by a monolithic body.

As shown in FIGS. 2 and 3, the core cavity 48 includes a plurality of pedestals 54 extending radially from the bottom wall 50 of the core cavity 48 to the top wall 52 thereof. As shown in FIG. 3, the pedestals 54 can be distributed in transversal rows with the pedestals 54 of adjacent rows being laterally staggered to create a tortuous path. The pedestals 54 are configured to disrupt the coolant flow through the core cavity 48 and, thus, increase heat absorption capacity. In addition to promoting turbulence to increase the heat transfer coefficient, the pedestals 54 increase the surface area capable to transferring heat from the hot side 36 of the turbine shroud segment 26, thereby proving more efficient and effective cooling. Accordingly, the cooling flow as the potential of being reduced. It is understood that the pedestals 54 can have different cross-sectional shapes. For instance, the pedestals 54 could be circular or oval in cross-section. The pedestals 54 are generally uniformly distributed over the surface the area of the core cavity 48. However, it is understood that the density of pedestals could vary over the surface area of the core cavity 48 to provide different heat transfer coefficients in different areas of the turbine shroud segment 26. In this way, additional cooling could be tailored to most thermally solicited areas of the shroud segments 26, using one simple cooling scheme from the front end portion to the rear end portion of the shroud segment 26. In use, this provides for a more uniform temperature distribution across the shroud segments 26.

As can be appreciated from FIG. 2, other types of turbulators can be provided in the core cavity 48. For instance, a row of trip strips 56 can be disposed upstream of the pedestals 54. It is also contemplated to provide a transversal row of stand-offs 58 between the strip strips 56 and the first row of pedestals 54. In fact, various combinations of turbulators are contemplated.

The cooling scheme further comprises a plurality of cooling inlets 60 for directing coolant from the plenum 46 into a front or upstream end of the core cavity 48. According to the illustrated embodiment, the cooling inlets 60 are provided as a transverse row of inlet passages along the front support leg 40. The inlet passages have an inlet end opening on the cooling plenum 46 just downstream (rearwardly) of the front support leg 40 and an outlet end opening to the core cavity 48 underneath the front support leg 40. As can be appreciated from FIG. 2, each inlet passage is angled forwardly to direct the coolant towards the front end portion of the shroud segment 26. That is each inlet passage is inclined to define a feed direction having an axial component pointing in an upstream direction relative to the flow of gases through the gas path 11. The angle of inclination of the cooling inlets 60 is an acute angle as measured from the radially outer surface 38 of the shroud segment 26. According to the illustrated embodiment, the inlets 60 are angled at about 45 degrees from the radially outer surface 38 of the shroud segment 26. If the inlet passages are formed by casting (they could also be drilled), the pedestals 54 may be configured to have the same orientation, including the same angle of inclination, as that of the as-cast inlet passages in order to facilitate the core de-molding operations. This can be appreciated from FIG. 2 wherein both the inlet passages and the pedestals are inclined at about 45 degrees relative to the bottom and top surfaces 50, 52 of the core cavity 48. As the combined cross-sectional area of the inlets 60 is small relative to that of the plenum 46, the coolant is conveniently accelerated as it is fed into the core cavity 48. The momentum gained by the coolant as it flows through the inlet passages contribute to provide enhance cooling at the front end portion of the shroud segment 26.

The cooling scheme further comprises a plurality of cooling outlets 62 for discharging coolant from the cavity core 48. As shown in FIG. 3, the plurality of outlets 62 includes a row of outlet passages distributed along the trailing edge 32 of the shroud segment 26. The trailing edge outlets 62 may be cast or drilled. They are sized to meter the flow of coolant discharged through the trailing edge 32 of the shroud segment 26. The cooling outlets 62 may comprise additional as-cast or drilled outlet passages. For instance, cooling passages (not shown) could be defined in the lateral sides 34 of the shroud body to purge hot combustion gases from between circumferentially adjacent shroud segments 26 or in the radially inner surface 36 of the shroud body to provide for the formation of a cooling film over the radially inner surface 36 of the shroud segments 26.

Referring to FIG. 3, it can be appreciated that the cooling scheme may also comprise a pair of turning vanes 59 in opposed front corners of the cooling cavity 48. The turning vanes 59 are disposed immediately downstream of the inlets 60 and configured to redirect a portion of the coolant flow discharged by the inlets 60 along the lateral sides 34 of the shroud body.

Now referring concurrently to FIGS. 2 and 3, it can be appreciated that the cooling scheme may further comprise a cross-over wall 63 in the upstream half or front half of the core cavity 48. A plurality of laterally spaced-part cross-over holes 65 are defined in the cross-over wall 63 to meter the flow of coolant delivered into the downstream or rear half of the core cavity 48. It is understood that the cross area of the cross-over holes 65 is less than that of the inlets 60 to provide the desired metering function. It can also be appreciated from FIG. 3, that the cross-over holes 65 comprises two lateral cross-over holes **65*a* along respective lateral sides of the core cavity 48 and that these lateral holes 65*a*** have a greater cross-section than that of the other cross-over holes 65. In this way, more coolant can flow adjacent the lateral sides 34 of the shroud segment 26. This provides additional cooling along the lateral sides which have been found to be more thermally solicited than other regions of the shroud segment 26. In this way, a more uniform temperature distribution can be maintained over the entire surface of the shroud segment.

The cooling scheme thus provides for a simple front-to-rear flow pattern according to which a flow of coolant flows front a front end portion to a rear end portion of the shroud segment 26 via a core cavity 48 including a plurality of turbulators (e.g. pedestals) to promote flow turbulence between a transverse row of inlets 60 provided at the front end portion of shroud body and a transverse row of outlets 62 provided at the rear end portion of the shroud body. In this way, a single cooling scheme can be used to effectively cool the entire shroud segment.

The shroud segments 26 may be cast via an investment casting process. In an exemplary casting process, a ceramic core C (see FIG. 4) is used to form the cooling cavity 48 (including the trip strips 56, the stand-offs 58 and the pedestals 54), the cooling inlets 60 as well as the cooling outlets 62. The core C is over-molded with a material forming the body of the shroud segment 26. That is the shroud segment 26 is cast around the ceramic core C. Once, the material has formed around the core C, the core C is removed from the shroud segment 26 to provide the desired internal configuration of the shroud cooling scheme. The ceramic core C may be leached out by any suitable technique including chemical and heat treatment techniques. As should be appreciated, many different construction and molding techniques for forming the shroud segments are contemplated. For instance, the cooling inlets 60 and outlets 62 could be drilled as opposed of being formed as part of the casting process. Also some of the inlets 60 and outlets 62 could be drilled while others could be created by corresponding forming structures on the ceramic core C. Various combinations are contemplated.

Figure 4:
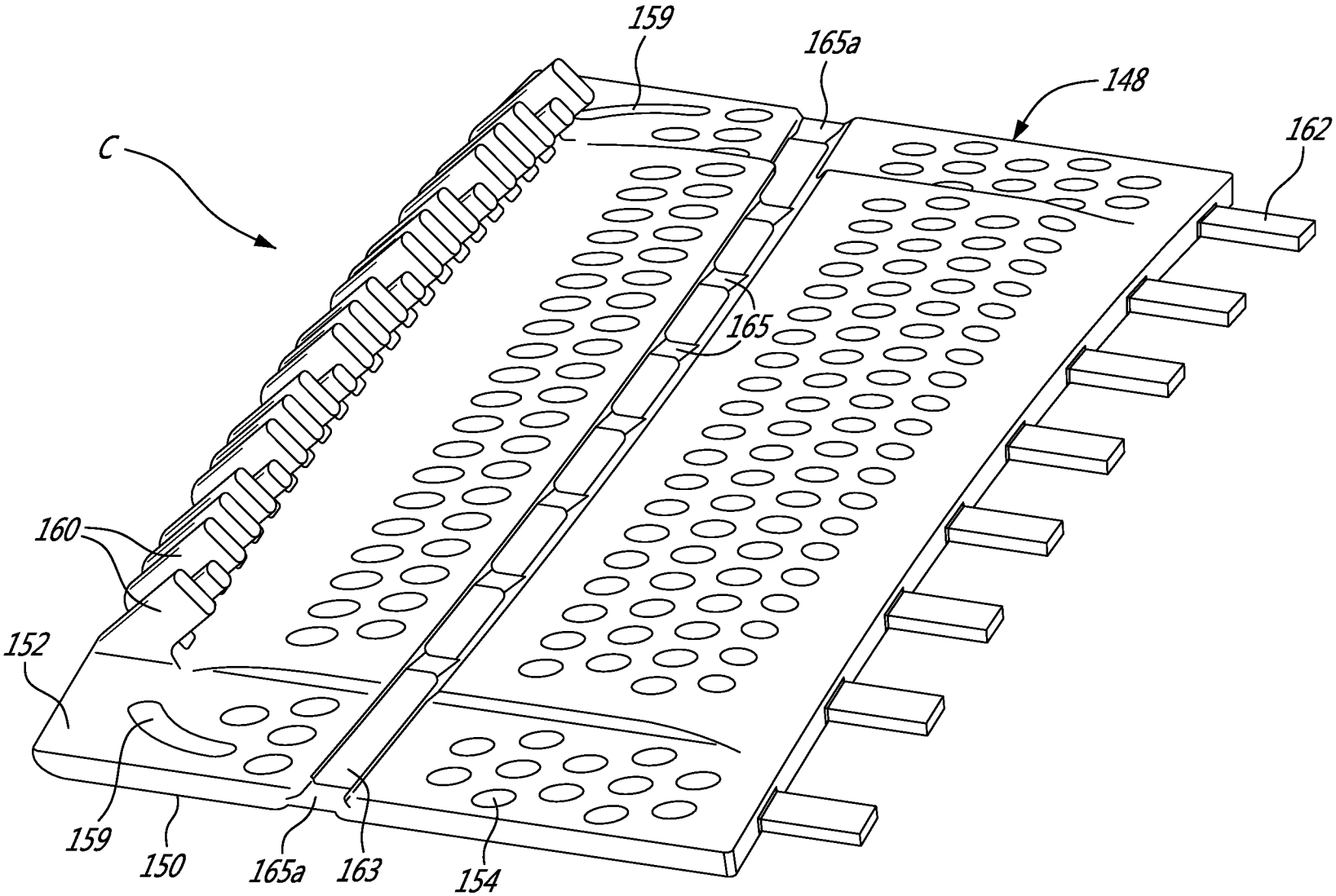
FIG. 4 is an isometric view of a casting core used to create the internal cooling scheme of the turbine shroud segment.

FIG. 4 shows an exemplary ceramic core C that could be used to form the core cavity 48 as well as as-cast inlet and outlet passages. The use of the ceramic core C to form at least part of the cooling scheme provides for better cooling efficiency. It may thus result in cooling flow savings. It can also result in cost reductions in that the drilling of long EDM holes and aluminide coating of the holes are no longer required.

It should be appreciated that FIG. 4 actually shows a "mirror" of the cooling circuit of FIGS. 2 and 3. Notably, FIG. 4 includes reference numerals that are identical to those in FIGS. 2 and 3 but in the hundred even though what is actually shown in FIG. 4 is the casting core C rather than the actual internal cooling scheme. More particularly, the ceramic core C has a body 148 having opposed bottom and top surfaces 150, 152 extending axially from a front end to a rear end. The body 148 is configured to create the internal core cavity 48 in the shroud segment 26. A front transversal row of ribs 160 is formed along the front end of the ceramic core C. The ribs 160 extend at an acute angle from the top surface 152 of the ceramic core C towards the rear end thereof, thereby allowing for the creation of as-cast inclined inlet passages in the front end portion of the shroud segment 26. Slanted holes 154 are defined through the ceramic body 148 to allow for the creation of pedestals 154. Likewise recesses (not shown) are defined in the core body 148 to provide for the formation of the trip strips 56 and the stand-offs 58. The pedestal holes 154 have the same orientation as that of the ribs 160 to simplify the core die used to form the core itself. It facilitates de-moulding of the core and reduces the risk of breakage. According to one embodiment, the ribs 160 and the holes 154 are inclined at about 45 degrees from the top surface 152 of the ceramic body 148. The casting core C further comprises a row of projections 162, such as pins, extending axially rearwardly along the rear end of the ceramic body 148 between the bottom and top surfaces 150, 152 thereof. These projections 162 are configured to create as-cast outlet metering holes 62 in the trailing edge 32 of the shroud segment 26.

The core C also comprises features 159, 163, 165 to respectively form the turning vanes 59, the cross-over wall 63 and the cross-over holes 65. It can be appreciated that the lateral cross-over pins 165*a* are larger than the inboard cross-over pins 165.

Figure 5:
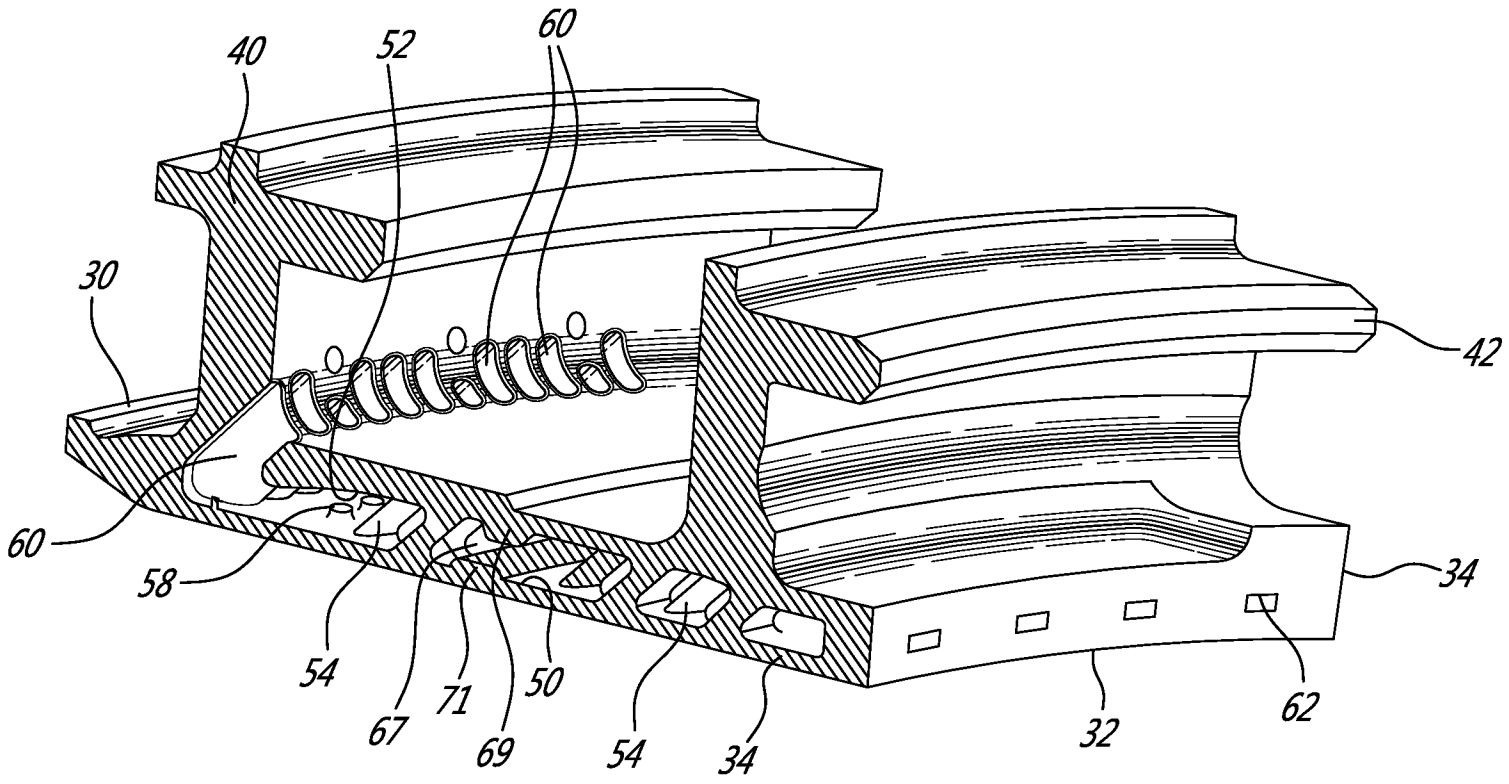
FIG. 5 is an isometric view of a shroud segment having an upstream plenum and a downstream plenum connected in flow communication via a flow constriction slot.

FIG. 5 illustrates a further embodiment in which the cross-over wall 63 and the laterally spaced-apart cross-over holes 65 have been replaced with a transversal throttling slot, throat or constriction 67 configured to restrict and accelerate the coolant flow from an upstream plenum to a downstream plenum of the core cavity 48. The slot 67 extends transversally (i.e. in the circumferential direction) from one axially extending side 34 to the opposed axially extending side 34, thereby dividing the cavity 48 into fluidly connected upstream and downstream plenums. As can be appreciated from FIG. 5, the flow constricting slot 67 can be defined between opposed top and bottom transversal ridges or bands 69, 71 projecting respectively from the top surface 52 and the bottom surface 50 of the core cavity 48. The top and bottom ridges 69, 71 cooperate to define therebetween a transversal constriction along the circumferential direction (i.e. the slot 67) at an intermediate location between the upstream and downstream ends of the core cavity 48. The transversally continuous flow constriction corresponding to slot 67 allows increasing the heat transfer coefficient, thereby leading to an improved cooling of the shroud. Indeed, the slot 67 has the role of restricting and accelerating the cooling flow as it passes from the upstream plenum to downstream plenum, serving as a restricted circumferentially continuous passage. It is understood that the slot area can vary along the length of the slot between the opposed axially extending sides 34 of the shroud segment. For instance, the slot 67 can include enlarged lateral end portions adjacent the lateral sides 34 of the shroud segment to increase cooling flow there along where the hottest areas tend to be. That is the slot area could be greater in the end portions of the slot 67 than in the central portion thereof. The slot area can be increased or reduced by varying the height of the top and bottom ridges 69, 71 (that is the amount by which the ridges 69, 71 protrude into the core cavity 48).

Figure 6:
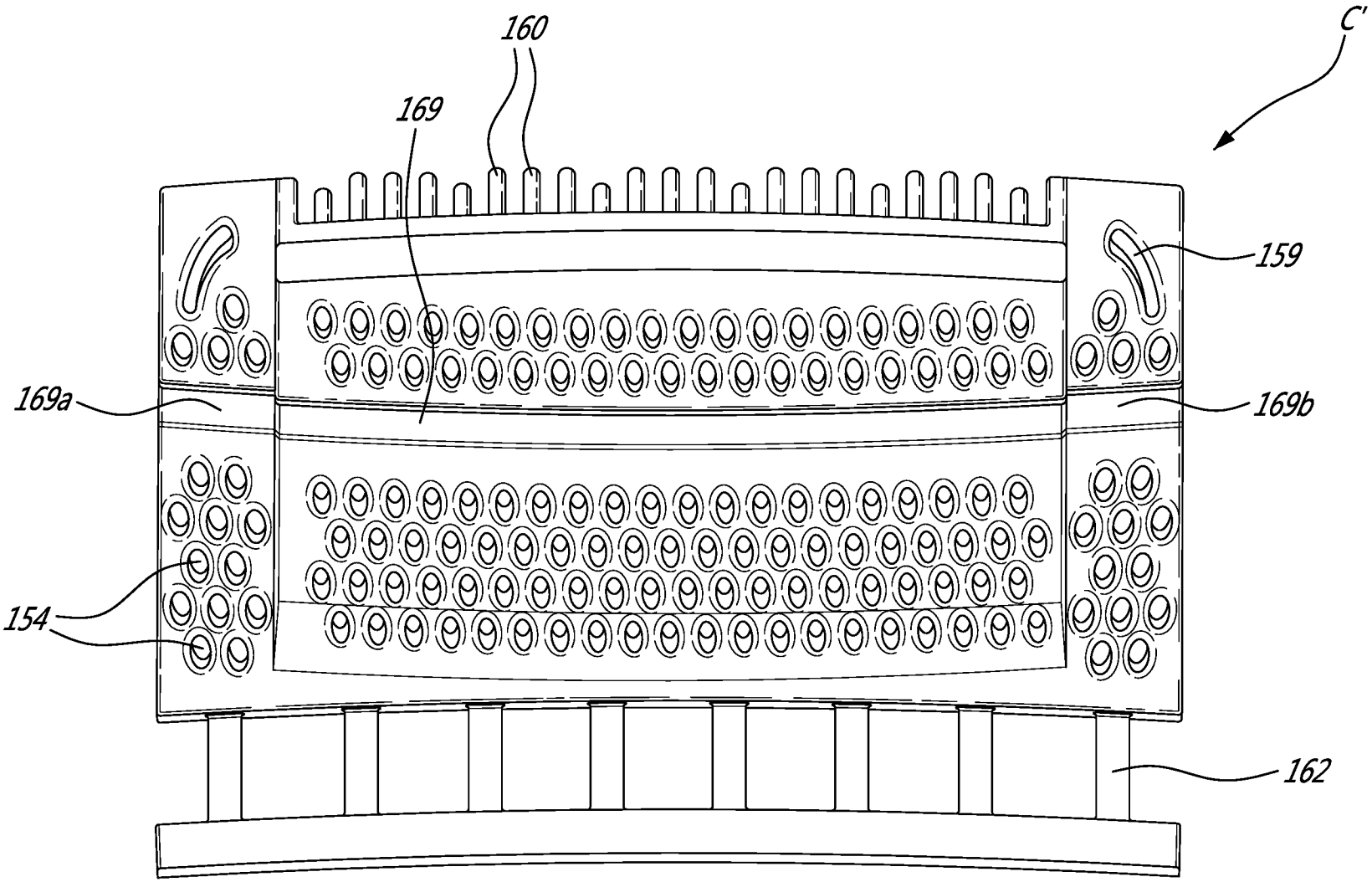
FIG. 6 is a top view of a casting core used to create the internal cooling scheme of the shroud segment shown in FIG. 5.

FIG. 6 shows a ceramic core C' that can be used to form the core cavity 48 of the exemplary shroud segment illustrated in FIG. 5. It can be appreciated that the intermediate transversal ridges 69, 70 respectively correspond to transversal slots defined in the top and bottom surface of the core C (only top slot 169' being shown in FIG. 6). It can also be seen that the slot 169 has opposed raised end portions 169*a*, 169*b* to increase the gap between the ridges 69, 70 in the end portions thereof adjacent the sides 34 of the shroud segment and, thus, increase the area in the end regions of the resulting constricting slot 67 in the finished shroud segment once the core has been leached out. The use of an intermediate constricting slot 67 instead of cross-over wall 63 allows increasing the rigidity of the core C'. Indeed, it eliminates the need for tiny pins 165 spaced by voids in the intermediate region of the core as for instance shown in FIG. 4. The rigidness of core C' shown in FIG. 6 can thus be improved relative to that of the core C shown in FIG. 4. Indeed, the front portion of the core C' can be connected to the rear portion thereof via a continuous solid transversal band portion instead of an array of spaced-apart pins.

According to other embodiments, the intermediate constricting slot 67 could include more than one slot. In other words, instead of being continuous, the slot 67 could be composed of a plurality of slot segments spaced by an inter-slot wall bridge.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

The invention claimed is:

1. A turbine shroud segment for a gas turbine engine having an annular gas path extending about an engine axis, the turbine shroud segment comprising: a body extending axially between a leading edge and a trailing edge and circumferentially between a first and a second lateral edge; a leading edge plenum and a trailing edge plenum defined in the body; a plurality of inlets in flow communication with the leading edge plenum; a plurality of outlets in flow communication with the trailing edge plenum; and a flow constricting slot extending circumferentially between the first and second lateral edges of the body, the flow constricting slot fluidly connecting the trailing edge plenum to the leading edge plenum, wherein the flow constricting slot defines a variable flow area along a length thereof.

2. The turbine shroud segment defined in claim 1, wherein the flow constricting slot has circumferentially opposed end portions adjacent the first and second lateral edges of the body, the opposed end portions having a greater flow area than that of an intermediate portion of the flow constricting slot.

3. The turbine shroud segment defined in claim 1, wherein the flow constricting slot is defined between a radially outer circumferential band projecting radially inwardly from a radially inwardly facing surface of the body and a radially inner circumferential band projecting radially outwardly from a radially outwardly facing surface of the body.

4. The turbine shroud segment defined in claim 1, wherein the flow constricting slot has a radial height which is less than that of the leading edge and trailing edge plenums.

5. A turbine shroud segment for a gas turbine engine having an annular gas path extending about an engine axis, the turbine shroud segment comprising: a body extending axially between a leading edge and a trailing edge and circumferentially between a first and a second lateral edge; an internal cavity defined in the body, the internal cavity having a top wall and a bottom wall; a top circumferential band extending from the top wall; a bottom circumferential band projecting from the bottom wall in axial alignment with the top circumferential band, the top circumferential band and the bottom circumferential band defining a circumferential slot therebetween and dividing the internal cavity into an upstream plenum and a downstream plenum, the downstream plenum connected in fluid flow communication with the upstream plenum via the circumferential slot; a plurality of inlets in flow communication with the upstream plenum; and a plurality of outlets in flow communication with the downstream plenum.

6. The turbine shroud segment defined in claim 5, wherein the circumferential slot defines a variable flow area along a circumferential direction.

7. The turbine shroud segment defined in claim 6, wherein the circumferential slot has circumferentially opposed end portions adjacent the first and second lateral edges of the body, the opposed end portions having a greater flow area than that of an intermediate portion of the circumferential slot.

8. A method of manufacturing a turbine shroud segment comprising: using a casting core to create an internal cooling circuit of the turbine shroud segment, the casting core having a body including a front portion connected to a rear portion by an intermediate portion, the intermediate portion have a thickness less than that of the front and rear portions to provide for the formation of a transversally extending flow constriction in an intermediate region of the turbine shroud segment, casting a cast body of the turbine shroud segment about the casting core; and removing the casting core from the cast body of the turbine shroud segment, wherein the casting core has a top surface and a bottom surface, and wherein transverse slots are defined in the top surface and the bottom surface, the transverse slots extending across the intermediate region, the transverse slots having a variable depth along a length thereof.

9. The method of claim 8, wherein the transverse slots have opposed end portions, and wherein a depth of the opposed end portions is deeper than a depth of a central portion of the transverse slots.

10. The method defined in claim 8, wherein the casting core further comprises a transverse row of ribs extending from a top surface of the front portion of the body of the casting core, and wherein the method comprises using the casting core to form as-cast inlet passages in a front portion of the turbine shroud segment.

11. The method defined in claim 8, wherein the casting core further comprises a transverse row of pins projecting from a rear end of the rear portion of the body of the casting core, and wherein the method comprises using the casting core to form as-cast outlet passages in a trailing edge of the turbine shroud segment.

12. A turbine shroud segment for a gas turbine engine having an annular gas path extending about an engine axis, the turbine shroud segment comprising: a body extending axially between a leading edge and a trailing edge and circumferentially between a first and a second lateral edge; a leading edge plenum and a trailing edge plenum defined in the body; a plurality of inlets in flow communication with the leading edge plenum; a plurality of outlets in flow communication with the trailing edge plenum; and a flow constricting slot extending circumferentially between the first and second lateral edges of the body, the flow constricting slot fluidly connecting the trailing edge plenum to the leading edge plenum, wherein the flow constricting slot is defined between a radially outer circumferential band projecting radially inwardly from a radially inwardly facing surface of the body and a radially inner circumferential band projecting radially outwardly from a radially outwardly facing surface of the body.

* * * * *